US010276115B2

(12) United States Patent
Kuo et al.

(10) Patent No.: US 10,276,115 B2
(45) Date of Patent: Apr. 30, 2019

(54) DISPLAY CIRCUIT AND LCD HAVING THE DISPLAY CIRCUIT

(71) Applicant: Shenzhen China Star Optoelectronics Technology Co., Ltd., Shenzhen, Guangdong (CN)

(72) Inventors: Ping-Sheng Kuo, Guangdong (CN); Tianhong Wang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 192 days.

(21) Appl. No.: 15/308,349

(22) PCT Filed: Sep. 27, 2016

(86) PCT No.: PCT/CN2016/100325

§ 371 (c)(1),
(2) Date: Nov. 1, 2016

(87) PCT Pub. No.: WO2018/040164

PCT Pub. Date: Mar. 8, 2018

(65) Prior Publication Data

US 2018/0190221 A1 Jul. 5, 2018

(30) Foreign Application Priority Data

Aug. 31, 2016 (CN) ..... 2016 1 0779458

(51) Int. Cl.
*G09G 3/36* (2006.01)

(52) U.S. Cl.
CPC ..... *G09G 3/3648* (2013.01); *G09G 3/3674* (2013.01); *G09G 3/3685* (2013.01);
(Continued)

(58) Field of Classification Search
CPC .. G09G 3/3648; G09G 3/3674; G09G 3/3685; G09G 2310/0272; G09G 2310/08
See application file for complete search history.

(56) References Cited

U.S. PATENT DOCUMENTS 9,225,327 B2 * 12/2015 Becker ..... H03K 17/162
9,590,508 B2 * 3/2017 Yashiki ..... H02M 3/1582
2007/0285383 A1 12/2007 Iizuka

FOREIGN PATENT DOCUMENTS

CN 101771402 A 7/2010
CN 101887701 A 11/2010
(Continued)

*Primary Examiner* — Charles V Hicks
(74) *Attorney, Agent, or Firm* — Andrew C. Cheng

(57) ABSTRACT

The invention provides a display circuit and a LCD having the display circuit. The display circuit includes a display unit, a level shifter, a timer controller, and scanning circuits. Each scanning circuit includes a first voltage stabilizing circuit including first and second field effect transistors. Source electrodes of the two transistors are connected to the level shifter. The scanning circuits send a first group of scanning signals to the display unit in sequence in a first period of time, and send a second group of scanning signals to the display unit in sequence in a second period of time. The timer controller sends a control signal to the level shifter in a time difference between the two groups of signals. The level shifter converts the control signal to a high level signal and sends it to the two transistors to enable the two transistors to be under reverse bias.

14 Claims, 4 Drawing Sheets

(52) U.S. Cl.
CPC ... *G09G 3/3692* (2013.01); *G09G 2310/0272* (2013.01); *G09G 2310/0289* (2013.01); *G09G 2310/08* (2013.01)

(56) References Cited

FOREIGN PATENT DOCUMENTS

| | | | |
|---|---|---|---|
| CN | 103258514 | A | 8/2013 |
| CN | 104464671 | A | 3/2015 |

* cited by examiner

DISPLAY CIRCUIT AND LCD HAVING THE DISPLAY CIRCUIT

BACKGROUND OF THE INVENTION

1. Field of the Invention

The present invention relates to displays, particularly relates to a display circuit and a liquid crystal display having the display circuit.

2. Description of Related Art

The liquid crystal displays (LCDs) is popular o users because of a small size, a light weight, and a good display quality. The present LCD includes scanning circuits. The scanning circuits include a plurality of voltage stabilizing circuits. Each voltage stabilizing circuit includes field effect transistors. The voltage difference Vgs, between the gate electrode and the source electrode of the field effect transistors, and the current Ids of the drain electrode and the source electrode of the field effect transistor has a transfer characteristic. The Ids-Vgs curve has a right shift after stress which induces an abnormal display of the LCD.

SUMMARY OF THE INVENTION

In order to overcome the deficiency of the related art, the purpose of the present invention is to provide a display circuit and a liquid crystal display having the display circuit.

The present invention provides a display circuit. The display circuit includes a display unit, a level shifter, a timer controller, and a plurality of scanning circuits. Each scanning circuit includes a first voltage stabilizing circuit. The first voltage stabilizing circuit includes a first field effect transistor and a second field effect transistor. Source electrodes of the two transistors connected to the level shifter. The plurality of scanning circuits send a first group of scanning signals to the display unit in sequence in a first period of time, and send a second group of scanning signals to the display unit in sequence in a second period of time. The timer controller sends a control signal to the level shifter in a time difference between the first period of time and the second period of time. The level shifter converts the control signal to a high level signal and sends the high level signal to the source electrodes of the two transistors to enable the two transistors to be under reverse bias, thereby improving a reliability of the first voltage stabilizing circuit.

As a further improvement, a drain electrode of the first field effect transistor is connected to the display unit, and a gate electrode of the first field effect transistor and a gate electrode of the second field effect transistor are connected to a pull-up circuit.

As a further improvement, each scanning circuit further comprises a third field effect transistor; the gate electrode of the first field effect transistor and the gate electrode of the second field effect transistor are connected to a drain electrode of the third field effect transistor; a source electrode of the third field effect transistor is connected to the level shifter; and a drain electrode of the second field effect transistor and a gate electrode of the third field effect transistor are connected to a precharge circuit.

As a further improvement, each scanning circuit further comprises a second voltage stabilizing circuit and a fourth field effect transistor; the second voltage stabilizing circuit comprises a fifth field effect transistor and a sixth field effect transistor; a gate electrode of the fourth field effect transistor is connected to the gate electrode of the third field effect transistor; a source electrode of the fourth field effect transistor is connected to the level shifter; a drain electrode of the fourth field effect transistor is connected to a second pull-up circuit; a source electrode of the fifth field effect transistor and a source electrode of the sixth field effect transistor are connected to the level shifter; a gate electrode of the fifth field effect transistor and a gate electrode of the sixth field effect transistor are connected to the drain electrode of the fourth field effect transistor; a drain electrode of the fifth field effect transistor is connected to the drain electrode of the first field effect transistor; and a drain electrode of the sixth field effect transistor is connected to the precharge circuit.

As a further improvement, each scanning circuit further comprises a seventh field effect transistor; a gate electrode of the seventh field effect transistor is connected to the precharge circuit; a drain electrode of the seventh field effect transistor is configured to connect to a clock signal circuit to receive a clock signal; and a source electrode of the seventh field effect transistor is the drain electrode of the first field effect transistor.

As a further improvement, the second pull-up circuit is a darlington circuit.

As a further improvement, the first pull-up circuit is a darlington circuit.

The present invention provides a liquid crystal display. The liquid crystal display includes a display circuit. The display circuit includes a display unit, a level shifter, a timer controller, and a plurality of scanning circuits. Each scanning circuit includes a first voltage stabilizing circuit. The first voltage stabilizing circuit includes a first field effect transistor and a second field effect transistor. Source electrodes of the two transistors connected to the level shifter. The plurality of scanning circuits send a first group of scanning signals to the display unit in sequence in a first period of time, and send a second group of scanning signals to the display unit in sequence in a second period of time. The timer controller sends a control signal to the level shifter in a time difference between the first period of time and the second period of time. The level shifter converts the control signal to a high level signal and sends the high level signal to the source electrodes of the two transistors to enable the two transistors to be under reverse bias, thereby improving a reliability of the first voltage stabilizing circuit.

The advantageous effects of the invention are as follows. The timer controller of the invention sends a control signal to the level shifter in the time difference between the first period of time and the second period of time. The level shifter converts the control signal to a high level signal and sends the high level signal to the source electrodes of the two transistors to enable the two transistors to be under reverse bias, thereby improving the reliability of the voltage stabilizing circuit and the image displayed by the display unit.

DETAILED DESCRIPTION OF THE PREFERRED EMBODIMENT

The following content combines with the figures and the embodiments for describing the present invention in detail. It is obvious that the following embodiments are only some embodiments of the present invention. For an ordinary person skilled in the art without any creative effort, other embodiments obtained thereby are still covered by the present invention.

Figure 1:
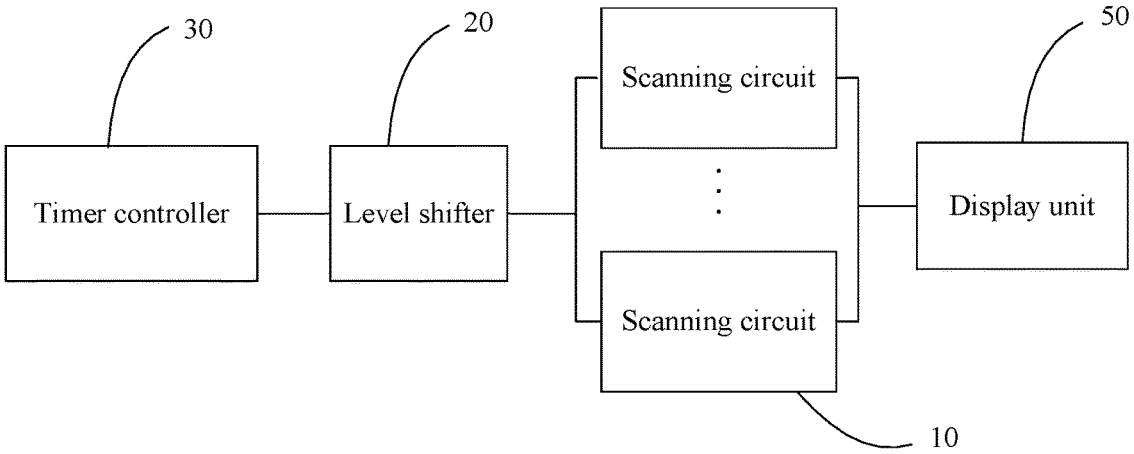
FIG. 1 is a block diagram of a liquid crystal display in accordance with one embodiment.
Figure 2:
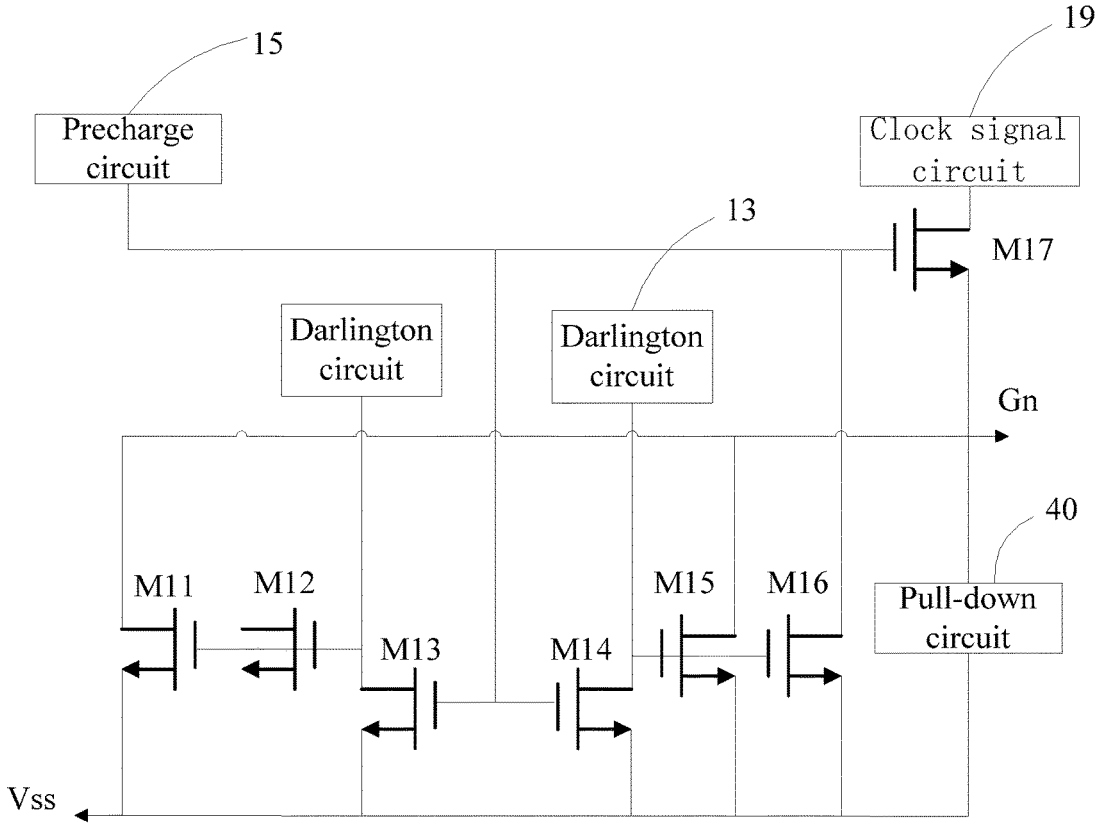
FIG. 2 is a circuit diagram of a display circuit in accordance with one embodiment.

Referring to FIGS. 1 and 2, a liquid crystal display in accordance with one embodiment includes a plurality of scanning circuit 10, a level shifter 20, a timer controller (TCON) 30, and a display unit 50.

Each scanning circuit 10 includes seven field effect transistors M11, M12, M13, M14, M15, M16, M17. The source electrodes of the field effect transistors M11, M12, M13, M14, M15, M16 are connected to each other and connected to the level shifter 20. The source electrodes of the field effect transistors M11, M12, M13, M14, M15, M16 are further connected to the display unit 50 via a pull-down circuit 40. The gate electrode of the field effect transistor M11 and the gate electrode of the field effect transistor M12 are both connected to the drain electrode of the field effect transistor M13. The drain electrode of the field effect transistor M11 is connected to the display unit 50. The drain electrode of the field effect transistor M13 is connected to a pull-up circuit. The drain electrode of the field effect transistor M12 is connected to the precharge circuit 15. The gate electrode of the field effect transistor M13 is connected to the precharge circuit 15.

The gate electrode of the field effect transistor M14 is connected to the gate electrode of the field effect transistor M13. The drain electrode of the field effect transistor M14 is connected to the pull-up circuit. In the embodiment, the pull-up circuit is a darlington circuit 13.

The gate electrode of the field effect transistor M15 is connected to the drain electrode of the field effect transistor M14. The drain electrode of the field effect transistor M15 is connected to the drain electrode of the field effect transistor M11. The gate electrode of the field effect transistor M16 is connected to the drain electrode of the field effect transistor M14. The drain electrode of the field effect transistor M16 is connected to the drain electrode of the field effect transistor M12. The gate electrode of the field effect transistor M17 is connected to the drain electrode of the field effect transistor M12. The source electrode of the field effect transistor M17 is connected to the drain electrode of the field effect transistor M11. The drain electrode of the field effect transistor M17 is used for connecting to a clock signal circuit 19 to receive a clock signal.

The field effect transistors M11 and field effect transistor M12 are combined as a first voltage stabilizing circuit. The field effect transistors M15 and field effect transistor M16 are combined as a second voltage stabilizing circuit.

Figure 3:
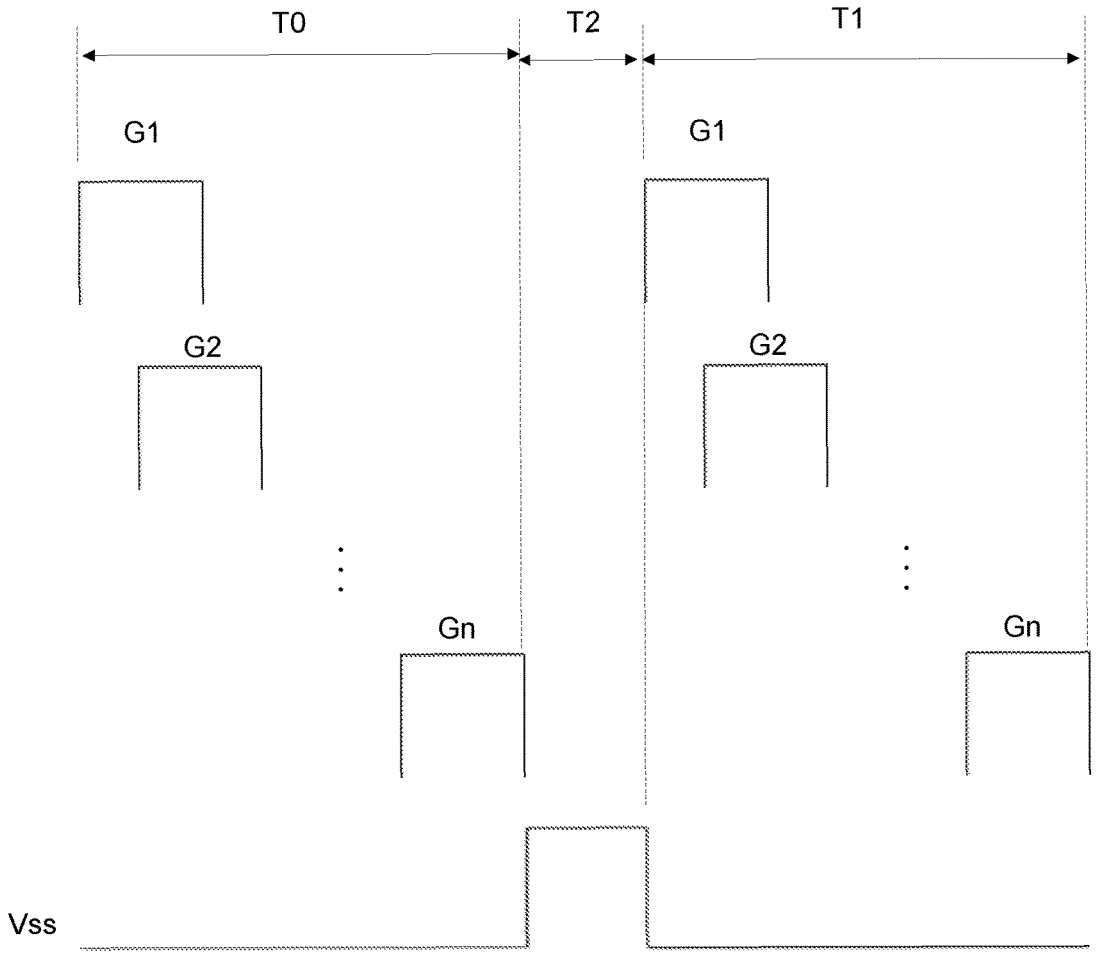
FIG. 3 is a sequence diagram of a display circuit in accordance with one embodiment.
Figure 4:
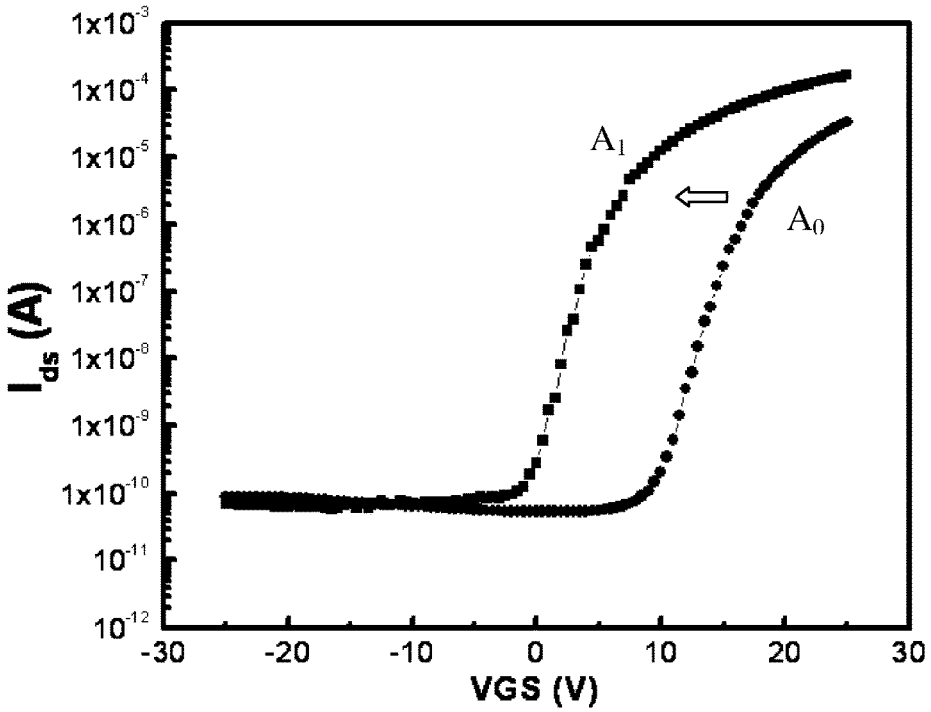
FIG. 4 is a curve graph of $V_{gs}$-$I_{ds}$ of the transistor of the display circuit in accordance with one embodiment.

Referring to FIGS. 3 and 4, in use, the plurality of scanning circuits 10 send a group of high level scanning signals G1, G2, . . . Gn in sequence in a period of time T0. The interval between every two adjacent scanning signals is a fixed time period. The plurality of scanning circuit sends a group of high level scanning signals G1, G2, . . . Gn in sequence in a period of time T1. There is a time difference T2 between the period of time T0 and the period of time T1. The timer controller 30 sends a control signal to the level shifter 20 in the time difference T2. There is a voltage difference $V_{GS}$ between the gate electrode and the source electrode of the field effect transistors M11, M12, M15, M16. There is a current $I_{ds}$ between the drain electrode and the source electrode of the field effect transistors M11, M12, M15, M16. The level shifter 20 converts the control signal to a high level signal Vss and sends the high level signal Vss to the scanning circuits 10, thereby enabling the field effect transistors M11, M12, M15, M16 to be under reverse bias. Thus, the voltage difference $V_{GS}$ decreases, and the Ids-Vgs curve shifts to left (A0 to A1) during the time difference T2, thereby improving the reliability of the first voltage stabilizing circuit and the second voltage stabilizing circuit. It also improves the reliability of the scanning signals sent from the scanning circuits 10 to the display unit 50, thereby improving the reliability of the image displayed by the display unit 50. In the time difference T2, the darlington circuits 13 output control signals to enable the field effect transistors M11, M12, M15, M16 to be switched off, thereby ensuring the reliability of the scanning signals G1, G2, . . . Gn. The pull-down circuit 40 is used for pulling down the scanning signals to be a low level when the high level of the scanning signals sent by the scanning circuits 10 lasts for a period of time.

For a person skilled in the art, obviously, the present invention is not limited to the above exemplary embodiments disclosed herein. Besides, without deviating the spirit and the basic feature of the present invention, other specific forms can also achieve the present invention. Therefore, no matter from what point of view, the embodiments should be deemed to be exemplary, not limited. The range of the present invention is limited by the claims not by the above description. Accordingly, the embodiments are used to include all variation in the range of the claims and the equivalent requirements of the claims. It should not regard any reference signs in the claims as a limitation to the claims.

What is claimed is:

1. A display circuit, comprising:

a display unit;

a level shifter;

a timer controller; and a plurality of scanning circuits, each scanning circuit comprising a first voltage stabilizing circuit, the first voltage stabilizing circuit comprising a first field effect transistor and a second field effect transistor; source electrodes of the two transistors connected to the level shifter; the plurality of scanning circuits configured to send a first group of scanning signals to the display unit in sequence in a first period of time, and to send a second group of scanning signals to the display unit in sequence in a second period of time;

wherein the timer controller is configured to send a control signal to the level shifter in a time difference between the first period of time and the second period of time; and the level shifter is configured to convert the control signal to a high level signal and send the high level signal to the source electrodes of the two transistors to enable the two transistors to be under reverse bias, thereby improving a reliability of the first voltage stabilizing circuit; and wherein the source electrodes of the first and second field effect transistors are connected directly to the level shifter and the high level signal supplied from the level shifter is directly applied to the source electrodes of the first and second field effect transistors for causing reverse biasing to the source electrodes of the first and second field effect transistors to reduce a voltage difference between a gate electrode of each of the first and second field effect transistors and the source electrode thereof.

2. The display circuit according to claim 1, wherein a drain electrode of the first field effect transistor is connected to the display unit, and the gate electrode of the first field effect transistor and the gate electrode of the second field effect transistor are connected to a pull-up circuit.

3. The display circuit according to claim 2, wherein each scanning circuit further comprises a third field effect transistor; the gate electrode of the first field effect transistor and the gate electrode of the second field effect transistor are connected to a drain electrode of the third field effect transistor; a source electrode of the third field effect transistor is connected to the level shifter; and a drain electrode of the second field effect transistor and a gate electrode of the third field effect transistor are connected to a precharge circuit.

4. The display circuit according to claim 3, wherein each scanning circuit further comprises a second voltage stabilizing circuit and a fourth field effect transistor; the second voltage stabilizing circuit comprises a fifth field effect transistor and a sixth field effect transistor; a gate electrode of the fourth field effect transistor is connected to the gate electrode of the third field effect transistor; a source electrode of the fourth field effect transistor is connected to the level shifter; a drain electrode of the fourth field effect transistor is connected to a second pull-up circuit; a source electrode of the fifth field effect transistor and a source electrode of the sixth field effect transistor are connected to the level shifter; a gate electrode of the fifth field effect transistor and a gate electrode of the sixth field effect transistor are connected to the drain electrode of the fourth field effect transistor; a drain electrode of the fifth field effect transistor is connected to the drain electrode of the first field effect transistor; and a drain electrode of the sixth field effect transistor is connected to the precharge circuit.

5. The display circuit according to claim 4, wherein each scanning circuit further comprises a seventh field effect transistor; a gate electrode of the seventh field effect transistor is connected to the precharge circuit; a drain electrode of the seventh field effect transistor is configured to connect to a clock signal circuit to receive a clock signal; and a source electrode of the seventh field effect transistor is the drain electrode of the first field effect transistor.

6. The display circuit according to claim 4, wherein the second pull-up circuit is a darlington circuit.

7. The display circuit according to claim 2, wherein the first pull-up circuit is a darlington circuit.

8. A liquid crystal display, comprising a display circuit, the display circuit comprising:

a display unit;

a level shifter;

a timer controller; and a plurality of scanning circuits, each scanning circuit comprising a first voltage stabilizing circuit, the first voltage stabilizing circuit comprising a first field effect transistor and a second field effect transistor; source electrodes of the two transistors connected to the level shifter; the plurality of scanning circuits configured to send a first group of scanning signals to the display unit in sequence in a first period of time, and to send a second group of scanning signals to the display unit in sequence in a second period of time;

wherein the timer controller is configured to send a control signal to the level shifter in a time difference between the first period of time and the second period of time; and the level shifter is configured to convert the control signal to a high level signal and send the high level signal to the source electrodes of the two transistors to enable the two transistors to be under reverse bias, thereby improving a reliability of the first voltage stabilizing circuit; and wherein the source electrodes of the first and second field effect transistors are connected directly to the level shifter and the high level signal supplied from the level shifter is directly applied to the source electrodes of the first and second field effect transistors for causing reverse biasing to the source electrodes of the first and second field effect transistors to reduce a voltage difference between a gate electrode of each of the first and second field effect transistors and the source electrode thereof.

9. The liquid crystal display according to claim 8, wherein a drain electrode of the first field effect transistor is connected to the display unit, and the gate electrode of the first field effect transistor and the gate electrode of the second field effect transistor are connected to a pull-up circuit.

10. The liquid crystal display according to claim 9, wherein each scanning circuit further comprises a third field effect transistor; the gate electrode of the first field effect transistor and the gate electrode of the second field effect transistor are connected to a drain electrode of the third field effect transistor; a source electrode of the third field effect transistor is connected to the level shifter; and a drain electrode of the second field effect transistor and a gate electrode of the third field effect transistor are connected to a precharge circuit.

11. The liquid crystal display according to claim 10, wherein each scanning circuit further comprises a second voltage stabilizing circuit and a fourth field effect transistor; the second voltage stabilizing circuit comprises a fifth field effect transistor and a sixth field effect transistor; a gate electrode of the fourth field effect transistor is connected to the gate electrode of the third field effect transistor; a source electrode of the fourth field effect transistor is connected to the level shifter; a drain electrode of the fourth field effect transistor is connected to a second pull-up circuit; a source electrode of the fifth field effect transistor and a source electrode of the sixth field effect transistor are connected to the level shifter; a gate electrode of the fifth field effect transistor and a gate electrode of the sixth field effect transistor are connected to the drain electrode of the fourth field effect transistor; a drain electrode of the fifth field effect transistor is connected to the drain electrode of the first field effect transistor; and a drain electrode of the sixth field effect transistor is connected to the precharge circuit.

12. The liquid crystal display according to claim 11, wherein each scanning circuit further comprises a seventh field effect transistor; a gate electrode of the seventh field effect transistor is connected to the precharge circuit; a drain electrode of the seventh field effect transistor is configured to connect to a clock signal circuit to receive a clock signal; and a source electrode of the seventh field effect transistor is the drain electrode of the first field effect transistor.

13. The liquid crystal display according to claim 11, wherein the second pull-up circuit is a darlington circuit.

14. The liquid crystal display according to claim 9, wherein the first pull-up circuit is a darlington circuit.

* * * * *